US007367730B2

(12) United States Patent
Donaldson et al.

(10) Patent No.: US 7,367,730 B2
(45) Date of Patent: May 6, 2008

(54) SHEET FED CONTINUOUS MOTION PRINTING SYSTEM

(75) Inventors: Thomas A. Donaldson, Lawrenceville, GA (US); Doyle W. Marlow, Acworth, GA (US)

(73) Assignee: International Paper Company, Memphis, TN (US)

( * ) Notice: Subject to any disclaimer, the term of this patent is extended or adjusted under 35 U.S.C. 154(b) by 40 days.

(21) Appl. No.: 11/592,738

(22) Filed: Nov. 3, 2006

(65) Prior Publication Data

US 2007/0147935 A1 Jun. 28, 2007

Related U.S. Application Data

(63) Continuation of application No. 10/253,345, filed on Sep. 24, 2002, now Pat. No. 7,134,798.

(51) Int. Cl.
*B41J 13/00* (2006.01)

(52) U.S. Cl. ..... 400/578; 400/522; 400/543; 400/624

(58) Field of Classification Search ..... 400/120.01, 400/521, 522, 525, 526, 528, 530, 533, 541, 400/543, 578, 624, 625, 626
See application file for complete search history.

(56) References Cited

U.S. PATENT DOCUMENTS 4,695,850 A 9/1987 Nubson
5,407,081 A 4/1995 Oshino et al.
5,426,283 A 6/1995 Berthozat et al.
5,959,278 A 9/1999 Kobayashi et al.
5,964,538 A * 10/1999 Herbert ..... 400/120.01
6,011,570 A 1/2000 Muranaka et al.
6,030,474 A 2/2000 Isono et al.
6,106,172 A * 8/2000 No ..... 400/120.01
6,313,856 B1 11/2001 Ulrich
6,408,151 B1 6/2002 Heno
6,451,149 B1 9/2002 McKenney et al.
6,511,237 B1 1/2003 Fujiwara

FOREIGN PATENT DOCUMENTS

JP 07061016 3/1995
JP 08048436 2/1996
JP 09011562 1/1997

* cited by examiner

*Primary Examiner*—Ren L Yan
(74) *Attorney, Agent, or Firm*—Matthew M. Eslami

(57) ABSTRACT

Method of printing individual header cards with a limited amount of information, such as a barcode, employing continuous movement of each of the header cards through a gap defined between a backup roll and a thermal printing head, each header card partially wrapping the backup roll only in the immediate vicinity of the printer head.

4 Claims, 4 Drawing Sheets

SHEET FED CONTINUOUS MOTION PRINTING SYSTEM

FIELD OF INVENTION

This invention relates to thermal printing of limited amounts of information on individual headers used in the display of merchandise in a retail outlet. The limited information commonly includes a barcode.

BACKGROUND OF INFORMATION

In the retail sales industry, automated tracking, control, and other functions relating to inventory offered for sale and/or sold has become the "norm". To this end, a barcode identified as a Universal Product Control has been developed. A UPC code is assigned to each product offered for sale. Commonly this code identifies the product, the seller, the sales price, and/or other information. Each UPC code is specific to its assigned owner/user.

Because a UPC barcode is specific to each user, the UPC barcode must be applied to individual items offered for sale by a specific user. Where large volumes of a product are sold to a given entity, the manufacturer can economically justify preprinting that entity's UPC barcode directly onto the packaging for a given product. On the other hand, where a specific user's purchase volume is relatively small, the user must attend to the application of their own barcode to the products which they offer for sale. Many instruments, devices, printers, and the like are currently available for the printing of barcode labels which can readily be applied, one by one, to individual products or to their packaging.

In the instance where a manufacturer or a distributor of a given product purchases the product in large quantities and thereafter sells or distributes the product to a large number of individual retail sellers, heretofore, the manufacturer or distributor often was forced to print out many different UPC codes (one for each of its customers) as labels and physically attach a label to each product. This process economically burdensome, especially from the aspect of the labor cost involved. This procedure is particularly applicable to those "middle man" distributors who purchase large quantities of a given product in bulk and thereafter either package or otherwise prepare each of the products for distribution to retailers of the product.

One example of products which are distributed and sold at retail are "flat goods" such as floor mats for automobiles. Bed sheets and other products also are at times sold as "flat goods". In the instance of automobile floor mats, a distributor (or the manufacturer itself) will employ a "header" or "header card" which serves the purposes of identifying the goods plus hanging the goods vertically for space-saving display in a retail outlet. Header cards commonly take the form of an individual sheet of paperboard which is folded about its transverse centerline and fitted over, and secured to, the top edge of the flat good (e.g. a floor mat). Commonly the header is hole-punched for hanging on a rack or the like. For a large quantity of a given flat good, a common header card is commonly printed and attached to the flat good. However, either the manufacturer or the distributor is called upon to apply a proper UPC barcode to each item of the flat goods to accommodate each of their individual buyers, who in turn, sell the product at retail. In the industry, this practice of printed and attaching individual UPC barcodes to header cards has been carried out by the manufacturer or distributor, irrespective of the quantity purchased by a given retailer, all as a matter of gaining sales. Such practice obviously is costly to the manufacturer or distributor in that the known prior art does not provide a system or device for continuously printing UPC barcode information on a selected number of header cards which have previously been printed with product graphics, etc. Rather, in the prior art the header cards were printable only on a one-by-one intermittent basis. That is, the header card being printed with barcode information had to be fed to a printer head and the forward motion of the header card halted while printing took place. In like manner, where thermal printing was employed, halting of forward movement of the header card at a "curing station" also was required. Control over the movement of such header cards and timing of the printing and curing were all sources of problems in such printing devices and systems.

SUMMARY OF INVENTION

In accordance with one aspect of the present invention there is provided a novel system for the continuous printing of a limited amount of information, such as a UPC barcode, on individual ones of a plurality of header cards. In the preferred embodiment of the present invention, each header card is individually fed, on a continuously forwardly moving conveyor to and through a printing station, thence to a collector of the printed cards. In the printing station, the disclosed system includes a print head and a backup roll disposed relative to the print head as to define a gap therebetween. Each header card, on the conveyor, is fed forward into and through the gap in a continuous forward motion, with printing of the desired limited information onto the card while in the region of the gap. Importantly, the present inventor has discovered that printing of the barcode information onto the surface of the card must be carried out while the card is arched to thereby present an arcuate printable surface of the card to a printer head. Thermal printing onto the card thus takes place only along an arc of the card surface thereby avoiding subsequent withdrawal of thermally applied ink from the card by the carrier of the ink image being applied to the surface of the header card. To this end, the present system includes first and second idler rolls disposed one on the downstream side of the backup roll and one on the upstream side of the backup roll. Further, the carrier for the header card and the header card itself, is fed under the first of these idler rolls on the downstream side of the backup roll, thence up and partially wrapping the outer circumference of the backup roll in the gap, thence downwardly and under the second of the idler rolls. By this means, the limited information of the barcode is continuously printed onto the surface of the header card and the card is moved away from the print head substantially immediately following deposit of the thermal print onto the card and before the "uncured" print becomes blurred or physically removed from the card by the carrier for the thermal print.

DETAILED DESCRIPTION OF INVENTION

Figure 1:
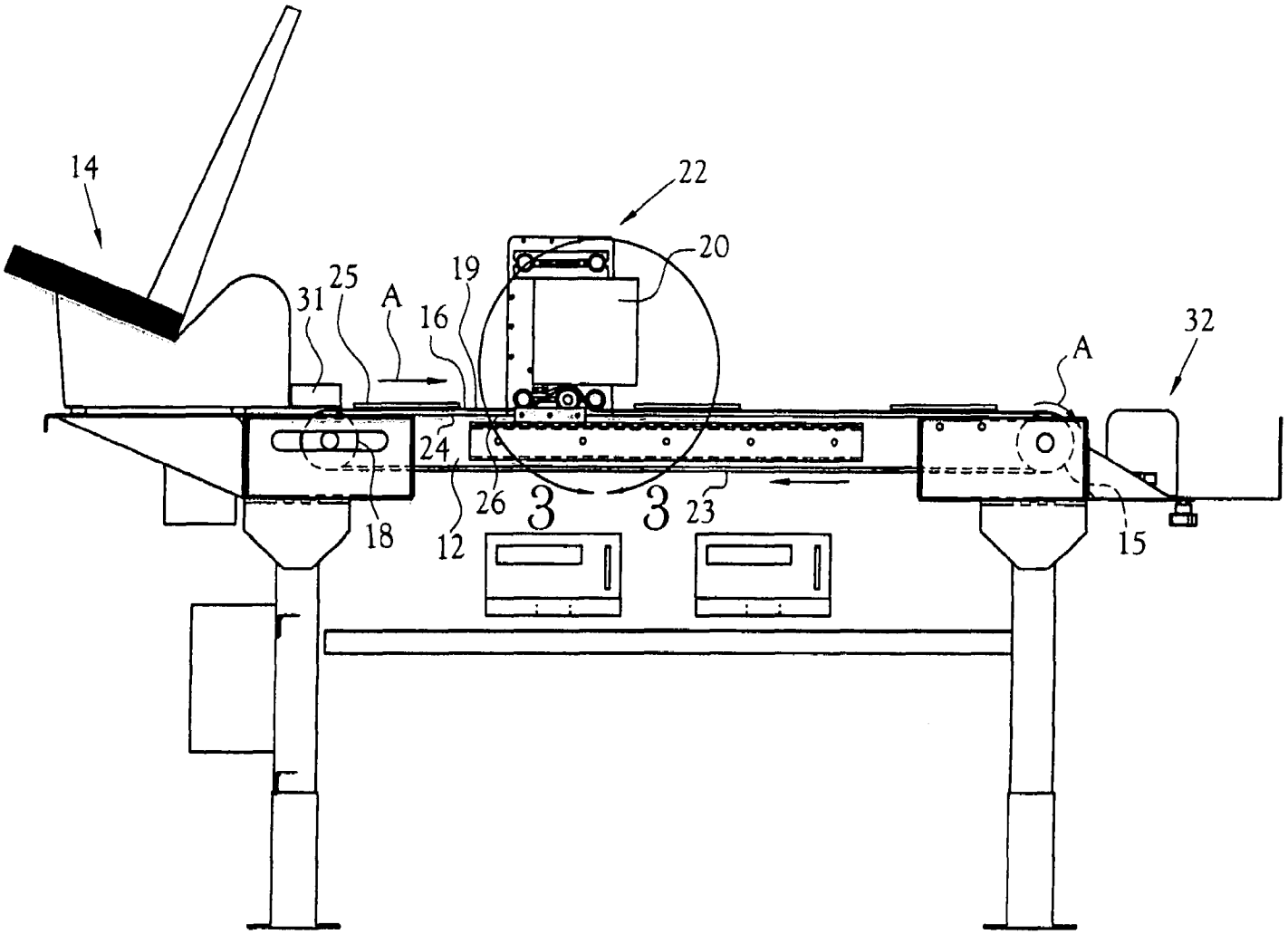
FIG. 1 is a side elevation view of a printer having incorporated therein a printer head of the present invention and depicting the flow of header cards into and through the printer.
Figure 2:
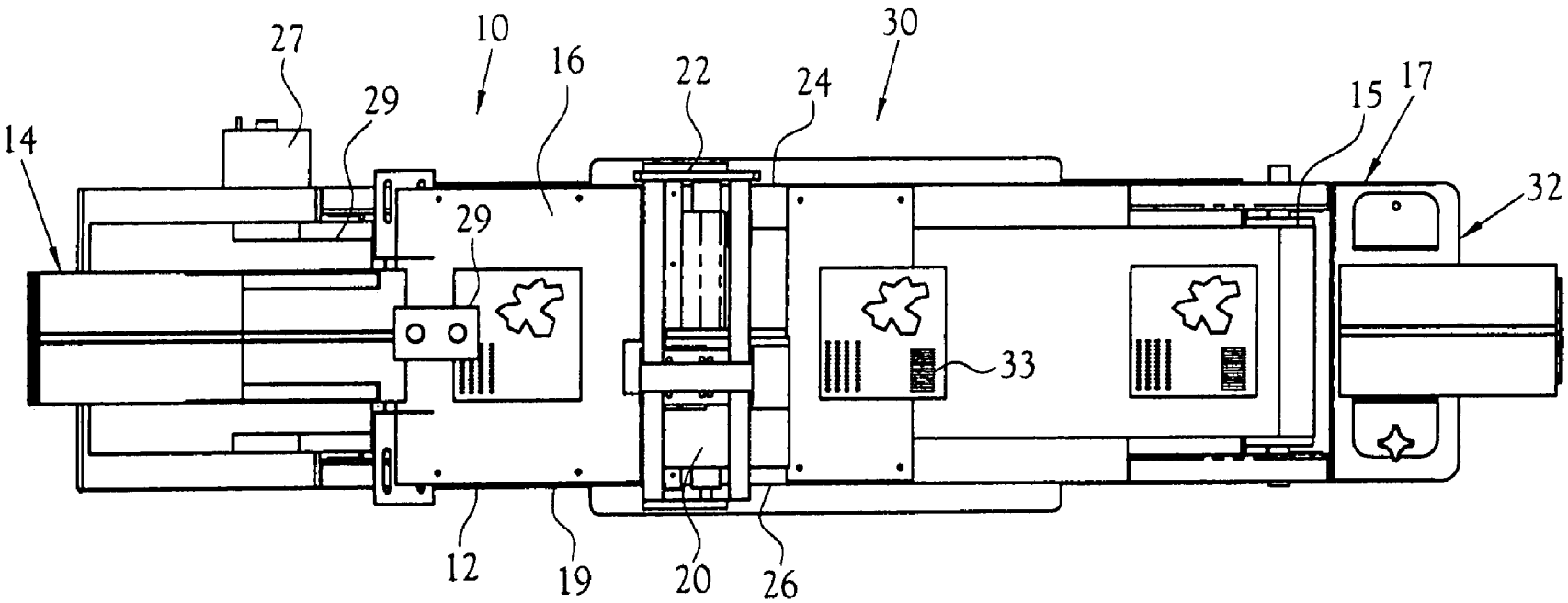
FIG. 2 is a top view of the printer depicted in FIG. 1.

Referring initially to FIGS. 1 and 2, one embodiment of a printer 10 of the present invention includes a support bench 12 which provides support for a sheet feeder 14, a conveyor 16 entrained about a drive roll 18 disposed adjacent and upstream of the sheet feeder and an idler roll 15 adjacent the downstream end of the support bench 12. The conveyor includes an upper run 19 which is supported by the top surface 21 of the support bench and a lower return run 23 and is selected to convey forwardly along its upper run a plurality of spaced apart individual sheets 25 of a printable material. Through the means of a drive system including a motor 27 and a drive train 31 connected to the drive roll 18, the conveyor is selectively driven continuously in a direction indicated by the arrows A of FIG. 1. Each of these elements of the printer are well known in the art, hence require minimal description of their structure and operation. A typical header (sheet) card is about 9 inches in length, as measured in the direction of its forward travel through the present system.

Figure 3:
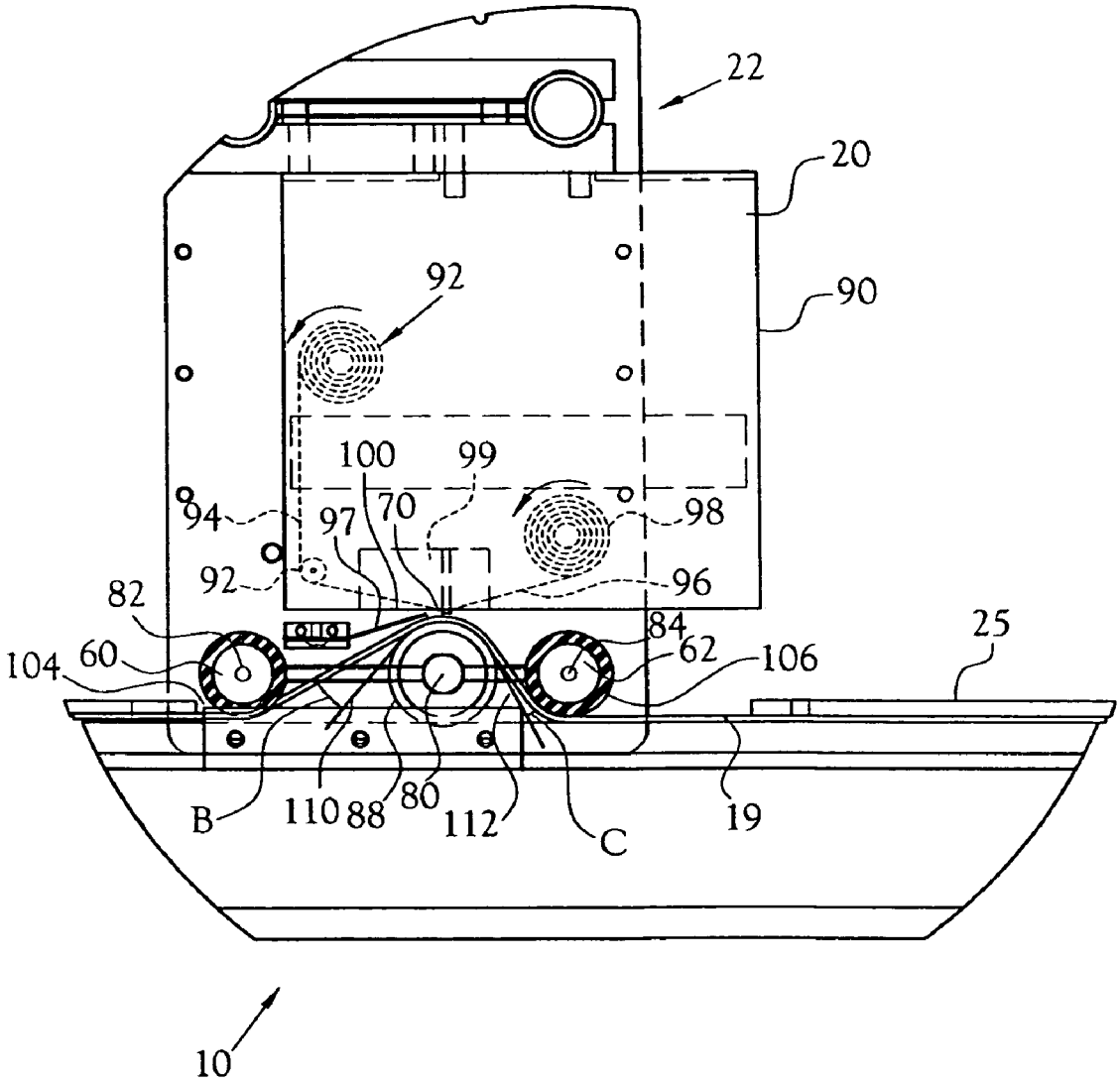
FIG. 3 is a enlarged side elevation view depicting various of the features of the printer head of the present invention; and, FIG. 4 is a representation of a mounting assembly of the printer head of the present invention.
Figure 4:
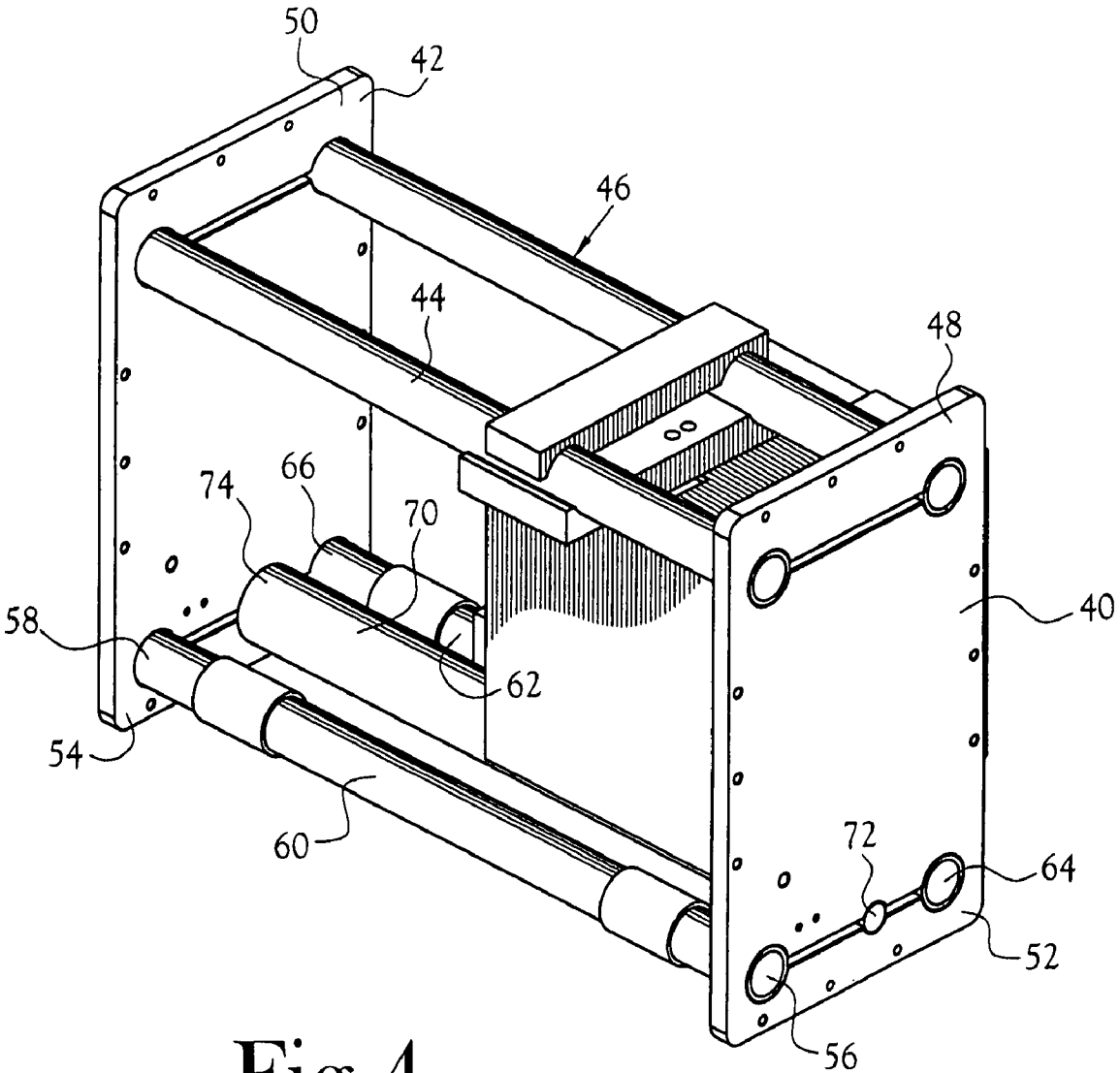

Referring to FIGS. 3 and 4, in conjunction with FIGS. 1 and 2, the depicted printer 10 includes a printer head 20 including a mounting assembly 22 by means of which the printer head is mounted to the opposite sides 24,26 of the support bench 12 in a superposed position above the upper run of the conveyor.

A collector 32 for printed sheets 25 is mounted to the support bench adjacent the downstream end of the conveyor.

In FIG. 4, it will be seen that in the depicted embodiment, one embodiment of a mounting assembly 22 for the printing head 20 of the present invention include first and second side members 40,42, first and second spaced apart spacer bars 44,46 each of which extends between the upper edges 48,50 of the first and second side members. The lower edges 52,54 of the first and second side members serve to rotatably mount respective ones of the opposite ends 56,58 of a first idler roll 60 and the opposite ends 64,66 of a spaced apart second idler roll 62 that extend between the opposite side members. Intermediate the first and second idler rolls, there is provided a backup roll 70 having one of its ends 72 rotatably mounted in the lower edge of the first side member 40 and its opposite end 74 rotatably mounted in the lower edge of the second side member 42. As depicted, the idler rolls are spaced apart from the backup roll by respective distances, one idler roll 60 being disposed upstream and the other idler roll 62 being disposed downstream of the backup roll 70.

As depicted in FIG. 3, in accordance with one aspect of the present invention, the backup roll 70 is of a larger diameter than either of the idler rolls, and the rotational axes 80,82, and 84, respectively, of the backup roll and the two idler rolls are disposed within a common plane which in the depicted embodiment is parallel to the plane occupied by the upper run of the conveyor. Moreover, as seen in FIG. 3, the distance separating the first (upstream) idler roll 60 from the backup roll is greater than the distance separating the second (downstream) idler roll 62 from the backup roll. This difference in separation distances serves to establish the angle of approach of a sheet of material (such as paperboard) being fed forwardly by the conveyor into wrapping engagement with the outer circumferential surface 88 of the backup roll and the exit angle defined by the sheet of material as it is moved out of wrapping engagement with the outer circumferential surface of the backup roll.

Referring specifically to FIG. 3,the depicted printer head includes a housing 90 and a supply 92 of thermal printing ribbon 94 comprising a carrier layer 96 on which there are intermittently spaced apart heat activatable ink deposits which are suitable for thermal transfer from the carrier layer to a material such as paperboard. In the present invention, these ink deposits may define a barcode 33 and/or other identifying information. Take up of the carrier layer downstream of the backup roll is provided for internally of the housing in a conventional and well known manner employing a takeup roll 98. Also mounted within the housing is a print head 99 adapted to heat the carrier 96 and ink deposits thereon to a temperature at which the ink is transferrable from the carrier and onto a printable material.

As depicted in FIGS. 1, 2 and 3, the outer circumference 88 of the backup roll is disposed directly beneath the print head 99 and the bottom surface of the print head 99 to define an open gap 100 therebetween. The width of the gap (ie. the separation distance between the outer circumference of the backup roll and the print head) is chosen to permit the receipt of the conveyor 16, a sheet of printable material, and the printing ribbon, into the gap, with the exposed surface 102 (upper surface as seen in FIG. 2) of the printable material facing the print head. It will be understood that the carrier of the printing ribbon faces the print head such that the ink thereon is exposed to the upper surface of the printable material in the gap.

In the operation of the present printer, individual sheets of printable material are fed from the feeder 14 consecutively onto the upper run 19 of the forwardly and continuously moving conveyor 16 at spaced apart intervals along the length of the upper run of the conveyor.

These sheets, on the conveyor, are fed into and through a nip 104 defined between the first idler roll 60 and the top surface of the support bench 12. Upon exiting the nip 104, the conveyor and a sheet of material thereon are directed into partial wrapping engagement with the outer circumference 88 of the backup roll 70, thence into and through the gap 100 between the backup roll and the print head. The conveyor and the sheet of printable material exiting the gap are directed into a nip 106 defined by the second idler roll 62 and the top surface of the support bench, thence to an idler (return) roll 15 adjacent the downstream end of the support bench. At the return roll, the printed sheet of material is separated from the conveyor and collected in the collector 32. The conveyor wraps the return roll and enters its lower run 23 toward the drive roll 18. In one embodiment the forward speed of the conveyor is between about 60 and 90 fpm.

Importantly, in accordance with the present invention, the angle of approach of the conveyor bearing a sheet of printable material to the backup roll must be chosen as a function of the stiffness of the sheet of printable material and must not be greater or less than that approach angle at which ensure no material separation of the sheet from the conveyor, nor any buckling of the sheet as it passes into the gap and/or as it passes through the gap. When employing a printable sheet of paperboard having a thickness of between about 0.016 inch and 0.030 inch and a backup roll having a diameter between about 1.688 and about 1.75 inches, it has been found that the angle of approach for the sheet and conveyor is between about 45 and about 55 degrees as measured using the angle indicated by the arrow B of FIG. 3 between the conveyor and a tangent 110 to the outer circumference of the backup roll at the point of engagement of the conveyor with such outer circumference. From FIG. 2, it will be noted that this approach angle delivers the sheet of material into the gap immediately ahead of the downstream side of the gap 100. This action permits the overlaying of the printing ribbon onto the exposed surface of the sheet immediately prior to the passage of the sheet and printing ribbon under the print head, and between the print head and the backup roll, thereby ensuring proper and adequate engagement between the printing ribbon and the sheet prior to heating of the printing ribbon and resultant thermal transfer of the ink from the printing ribbon onto the sheet.

In the depicted embodiment, the present inventors provide a flat strip of metal 101, which extends along the length of the backup roll and has an edge 102 thereof disposed adjacent the nip 104 to serve as a guide to direct the leading edge of a sheet 25 of printable material into the nip 104.

Thermally printed ink on the surface of a printable material is readily removed as a consequence of the ink being "pulled" off the surface of the printable material as the printable material exits the heat transfer (printing) station. This problem has heretofore required intermittent feeding of sheet material to the printing station of a printer so that the sheet material may have its forward movement halted for a time sufficient to ensure full transfer of the ink to the sheet before the sheet leaves the thermal transfer environment created by the print head. The present inventors have found that this prior art problem may be solved, and continuous movement of the sheet material through the printer achieved, by ensuring that the sheet material exits the gap between the print head and backup roll at a relatively sharper angle than the approach angle, thereby ensuring full and effective separation of the carrier layer from the ink-bearing surface of the sheet without withdrawal of the ink from the sheet by the moving carrier of the printing ribbon. To this end, the forward movement of the printing ribbon is maintained at the same forward speed as the forward movement of the conveyor and there is assured that no slippage or separation of the sheet relative to either the conveyor or the printing ribbon takes place. This relationship is maintained throughout the time and extent of passage of the printing ribbon and the sheet through the gap between the print head and the backup roll. Moreover, the present inventors have found that the exit angle (Arrow C of FIG. 3) of the conveyor, hence the sheet material, as measured by the angle defined between the conveyor and a tangent 112 to the outer circumference of the backup roll at the point of disengagement of the conveyor from the backup roll from the gap is to be maintained less than the entrance angle B. To this end, the lateral spacing of the second idler roll downstream from the backup roll is established such that the conveyor is maintained in wrapping engagement with the outer circumference of the backup roll for a maximum distance after the conveyor has exited the gap. This arrangement is best seen in FIG. 3 wherein the conveyor is seen to leave its wrapping engagement with the outer circumference of the backup roll at or very near the horizontal level of the rotational axis 80 of the backup roll. In the specific embodiment referenced hereinabove, the angle C preferably ranges between about 20 and about 30 degrees. Accordingly, the printed area on the sheet material is removed substantially instantaneously from the carrier of the printing ribbon and before the carrier can withdraw ink from the sheet.

Whereas specific embodiments of various elements of the invention have been described herein, other equivalent embodiments will be recognizable by one skilled in the art.

The invention claimed is:

1. A system for the thermal printing of a limited amount of information onto a header card comprising a printer including a thermal printing head, a backup roll disposed adjacent said printing head and defining with said printing head a gap therebetween, a first idler roll disposed ahead of said backup roll, a second idler roll disposed downstream of said backup roll, said first and second idler rolls being spaced apart from and relative to said backup roll by respective distances which provide for wrapping of a header card about the outer circumference of said backup roll by a distance of about two and about two and one-half inches of the circumference of said backup roll and including said gap, continuously conveying said header card forwardly through said gap, thermally printing a limited amount of information on said header card as it is fed through said gap.

2. The system of claim 1 wherein said header card is of about 9inches in length as measured along its forward direction of motion through said gap.

3. The system of claim 1 wherein said header card is of a thickness between about 0.016 and about 0.030 inch.

4. The system of claim 3 wherein each of said backup roll and said first and second idler rolls includes a rotational axis which extends substantially perpendicular to the direction of forward movement of said header card through said gap, said respective rotational axes being substantially parallel to one another, and wherein said rotational axis of each of said idler roll is disposed at a horizontal distance and a vertical distance as causes said header card to wrap between about two and about two and one-half inches of the outer circumference of said backup roll.

* * * * *